US012577773B2

(12) United States Patent
Wagner, III

(10) Patent No.: US 12,577,773 B2
(45) Date of Patent: Mar. 17, 2026

(54) MODULAR DECKING SYSTEM

(71) Applicant: Fred A. Wagner, III, Charlotte, NC (US)

(72) Inventor: Fred A. Wagner, III, Charlotte, NC (US)

( * ) Notice: Subject to any disclaimer, the term of this patent is extended or adjusted under 35 U.S.C. 154(b) by 519 days.

(21) Appl. No.: 17/336,681

(22) Filed: Jun. 2, 2021

(65) Prior Publication Data

US 2021/0395993 A1 Dec. 23, 2021

Related U.S. Application Data

(60) Provisional application No. 63/041,196, filed on Jun. 19, 2020.

(51) Int. Cl.

| | |
|---|---|
| ***E04B 1/00*** | (2006.01) |
| ***E04B 1/343*** | (2006.01) |
| ***E04B 5/12*** | (2006.01) |
| *E04F 15/02* | (2006.01) |
| *E04F 15/024* | (2006.01) |

(52) U.S. Cl.

CPC ..... *E04B 1/003* (2013.01); *E04B 1/34321* (2013.01); *E04B 5/12* (2013.01); *E04F 15/02183* (2013.01); *E04F 15/02411* (2013.01); *E04F 15/02476* (2013.01)

(58) Field of Classification Search

CPC ..... E04B 1/003; E04B 1/34321; E04B 5/12
USPC ..... 52/126.7
See application file for complete search history.

(56) References Cited

U.S. PATENT DOCUMENTS

| | | | | | |
|---|---|---|---|---|---|
| 502,623 | A * | 8/1893 | Harrison | E04H 17/08 | 52/297 |
| 2,345,018 | A * | 3/1944 | Walter | E04B 1/10 | 52/584.1 |
| 2,535,956 | A * | 12/1950 | Roggensack | E04B 1/36 | 248/354.3 |
| 2,795,825 | A * | 6/1957 | Miller | E04B 1/10 | D25/61 |
| 2,825,098 | A * | 3/1958 | Hultquist | E04B 1/02 | 52/584.1 |
| 2,829,403 | A * | 4/1958 | William | E04B 5/12 | 52/783.17 |
| 3,186,037 | A * | 6/1965 | Sklaroff | E04B 5/12 | 52/483.1 |

(Continued)

FOREIGN PATENT DOCUMENTS

| | | | | |
|---|---|---|---|---|
| AU | 6438699 A | * | 6/2000 | |
| EP | 2977517 A1 | * | 1/2016 | E04B 1/003 |

(Continued)

*Primary Examiner* — Brian D Mattei
*Assistant Examiner* — Joseph J. Sadlon
(74) *Attorney, Agent, or Firm* — ASHLEY LAW FIRM P.C.; Stephen S. Ashley, Jr.

(57) ABSTRACT

A modular decking system includes a plurality of modular components. Each component has a frame, a deck, a jack screw, and alignment blocks. The frame includes a pair of vertically disposed and offset boards banding the exterior periphery with internal cross members and block adjacent corners. The deck is a plurality of boards fitting within the offset boards of the frame's periphery. The screw jacks are located within the corner blocks. The alignment blocks affixed to the frame's periphery are used to position one modular component adjacent another modular component.

11 Claims, 4 Drawing Sheets

(56) References Cited

U.S. PATENT DOCUMENTS 3,364,636 A * 1/1968 Salsig, Jr. ..... H05H 7/00 52/27
3,511,001 A * 5/1970 Morgan, Jr. ..... E04F 15/02476 52/480
3,714,752 A * 2/1973 Ratliff, Jr. ..... E04B 1/5806 52/665
4,058,909 A * 11/1977 Poleri ..... A63H 33/044 434/72
4,124,962 A * 11/1978 Lancelot, III ..... E04B 1/2612 52/702
4,180,232 A * 12/1979 Hardigg ..... B29C 45/26 249/102
4,258,516 A * 3/1981 Mori ..... E04F 15/02476 52/126.6
4,354,678 A * 10/1982 Heddon ..... A63D 1/02 52/459
4,736,555 A * 4/1988 Nagare ..... E04F 15/02494 248/561
4,885,882 A * 12/1989 Forshee ..... B63B 3/48 52/177
4,888,926 A * 12/1989 Lutz, III ..... E04B 5/12 52/489.1
4,947,612 A * 8/1990 Taylor ..... E04B 5/12 52/693
4,972,635 A * 11/1990 Wageman ..... E04B 1/70 52/404.3
4,974,384 A * 12/1990 Pacione ..... E04B 5/04 52/483.1
4,982,538 A * 1/1991 Horstketter ..... E04B 5/046 52/340
5,058,343 A * 10/1991 Nipko ..... E04B 2/702 52/233
5,074,084 A * 12/1991 Kriss ..... E04B 5/14 52/73
5,150,557 A * 9/1992 Gregory ..... E04G 11/48 248/688
5,168,681 A * 12/1992 Ayrapetyan ..... E04B 5/12 52/847
5,327,699 A * 7/1994 Khan ..... E04B 1/14 52/93.2
5,367,853 A * 11/1994 Bryan ..... E04B 5/12 52/289
5,456,053 A * 10/1995 Fischer ..... E04F 21/22 254/113
5,475,959 A * 12/1995 Mackenzie ..... E04B 1/84 52/403.1
5,501,048 A * 3/1996 Nakanishi ..... E04B 1/0007 52/295
5,561,950 A * 10/1996 Collins ..... E02D 27/32 248/354.3
5,617,689 A * 4/1997 Beane ..... E04C 3/28 52/489.1
5,623,803 A * 4/1997 Willis ..... E04H 17/168 52/480
5,718,092 A * 2/1998 Corston ..... E04B 2/7412 52/480
5,720,067 A * 2/1998 Grearson ..... E01D 19/125 52/126.5
5,836,128 A * 11/1998 Groh ..... E04F 15/10 52/775
5,910,085 A * 6/1999 Pruett ..... E04B 5/12 52/480
5,953,874 A * 9/1999 Hoffman ..... E02D 27/02 52/294
6,098,360 A * 8/2000 Johnson ..... E04C 3/29 52/246
6,101,776 A * 8/2000 Conley ..... E04F 15/14 52/355
6,151,853 A * 11/2000 Fukunaga ..... E04F 15/02044 52/286
6,189,274 B1 * 2/2001 Ollikainen ..... E04B 1/84 52/480
6,247,677 B1 * 6/2001 Vinet ..... B28B 7/0014 249/189
6,260,322 B1 * 7/2001 Lindsay ..... E04B 5/48 52/650.1
6,272,810 B1 * 8/2001 Ingram ..... E02D 27/02 249/34
6,345,474 B1 * 2/2002 Triplett ..... E02D 27/01 52/126.6
6,463,710 B1 * 10/2002 Barnhart ..... E04G 21/00 249/40
6,554,699 B1 * 4/2003 Johansson ..... E04F 15/02044 454/169
6,625,943 B1 * 9/2003 Renner ..... E04B 5/12 52/319
6,698,152 B1 * 3/2004 Bush ..... E04C 3/18 52/693
6,918,221 B2 * 7/2005 Williams ..... E04B 5/026 52/592.1
6,968,652 B1 * 11/2005 Eadie ..... E04B 5/12 52/630
8,186,115 B2 * 5/2012 Harig ..... E02D 27/00 52/106
8,393,127 B1 * 3/2013 Jensen ..... E04H 3/02 52/645
8,448,406 B2 * 5/2013 Shepard ..... E04B 1/10 52/262
8,458,972 B1 * 6/2013 Stodola ..... E04B 2/825 52/284
8,474,194 B2 * 7/2013 Tiramani ..... E04B 1/3442 52/79.8
8,490,234 B2 * 7/2013 Rowell ..... E04F 15/0247 14/2.4
8,601,756 B2 * 12/2013 McNamee ..... E04B 5/10 52/177
8,656,655 B2 * 2/2014 Thiessen ..... B65D 90/24 52/169.8
8,776,477 B2 * 7/2014 Sprague ..... E04F 11/1851 52/126.5
8,800,217 B1 * 8/2014 Miller ..... E04B 7/022 52/79.9
8,978,339 B2 * 3/2015 Doupe ..... E04B 1/003 52/92.2
9,169,633 B2 * 10/2015 DiGregory ..... E04B 1/34321
9,249,574 B2 * 2/2016 Mei ..... E04B 1/19
9,777,484 B2 * 10/2017 Header ..... E04F 11/1853
9,932,734 B1 * 4/2018 Winter ..... E04B 1/5831
9,976,296 B2 * 5/2018 Nish ..... E04B 1/34347
10,053,858 B2 * 8/2018 Kopish ..... E04B 2/74
10,260,224 B1 * 4/2019 Jazzar ..... E04G 11/38
10,273,639 B2 * 4/2019 Penland, Jr. ..... E01C 5/006
10,494,814 B2 * 12/2019 Mei ..... E04C 3/122
11,060,301 B2 * 7/2021 Neill ..... E04F 15/02183
11,162,275 B2 * 11/2021 Heschel ..... E04H 17/009
11,261,609 B2 * 3/2022 Pommier ..... E04F 15/024
11,441,307 B2 * 9/2022 Huang ..... E04C 2/384
11,512,491 B2 * 11/2022 West ..... E04H 12/2276
11,519,174 B2 * 12/2022 Dicaire ..... E04B 2/707
11,566,419 B2 * 1/2023 Durali ..... E04B 1/8409
11,578,486 B2 * 2/2023 Lang ..... E04B 5/48
11,732,776 B2 * 8/2023 Graber ..... B21F 9/002 256/67
11,828,079 B2 * 11/2023 Hageman ..... G08B 21/182
11,905,718 B2 * 2/2024 Jasinski ..... E04F 15/18
11,920,357 B2 * 3/2024 Smith ..... E04F 15/02183
12,054,934 B2 * 8/2024 Power ..... E04D 13/04
12,065,829 B2 * 8/2024 Wu ..... B32B 7/03
12,180,725 B2 * 12/2024 Parsons ..... E04B 1/003
2002/0195593 A1 * 12/2002 Ardrey, Jr. ..... B66F 3/46 254/100
2004/0006936 A1 * 1/2004 Chezum ..... E04B 1/34342 52/169.12
2004/0237439 A1 * 12/2004 Powell ..... E04B 1/34823 52/505
2007/0017173 A1 * 1/2007 Kim ..... E04F 15/02476 52/220.1
2008/0168740 A1 * 7/2008 Lambdin ..... E04G 5/025 52/699

(56) References Cited

U.S. PATENT DOCUMENTS

| | | | | |
|---|---|---|---|---|
| 2009/0071083 | A1* | 3/2009 | Huang | E04F 15/02411 52/223.7 |
| 2009/0293378 | A1* | 12/2009 | Benson | E04F 15/02044 52/126.6 |
| 2011/0214369 | A1* | 9/2011 | Weber | E04B 1/003 52/832 |
| 2015/0096837 | A1* | 4/2015 | Aguilar | E04F 15/02038 182/115 |
| 2016/0168850 | A1* | 6/2016 | Anseth | E04B 5/10 52/645 |
| 2018/0163411 | A1* | 6/2018 | Bachelder | E04F 15/02038 |
| 2020/0240132 | A1* | 7/2020 | Barreto | A47B 87/008 |
| 2020/0340255 | A1* | 10/2020 | Weller | E04B 5/48 |

FOREIGN PATENT DOCUMENTS

| | | | | |
|---|---|---|---|---|
| JP | H04265358 | A | * | 9/1992 |
| JP | 2009167622 | A | * | 7/2009 |
| JP | 5968838 | B2 | * | 8/2016 |

* cited by examiner

MODULAR DECKING SYSTEM

RELATED APPLICATION

This application claims the benefit of U.S. Provisional Patent Application No. 63/041,196 filed Jun. 19, 2020, incorporated herein by reference.

FIELD OF THE INVENTION

This invention is directed to modular decking and its use.

BACKGROUND OF THE INVENTION

There is a need for modular decking, for example, see www.quick-deck.com. In view of the existing market for such modular decking, there is a need for more economically priced, more easily transported, and more easily erected and removed modular decking that may be used, for example, as retail backyard decking, as rental platforms, in tradeshows, and on trails in parks or recreation systems, as ADA compliant elevated walkways and/or bridges.

Accordingly, there is a need for an improved modular decking system that addresses the foregoing needs.

SUMMARY OF THE INVENTION

A modular decking system includes a plurality of modular components. Each component has a frame, a deck, a jack screw, and alignment blocks. The frame includes a pair of vertically disposed and offset boards banding the exterior periphery with internal cross members and block adjacent corners. The deck is a plurality of boards fitting within the offset boards of the frame's periphery. The screw jacks are located within the corner blocks. The alignment blocks affixed to the frame's periphery are used to position one modular component adjacent another modular component.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
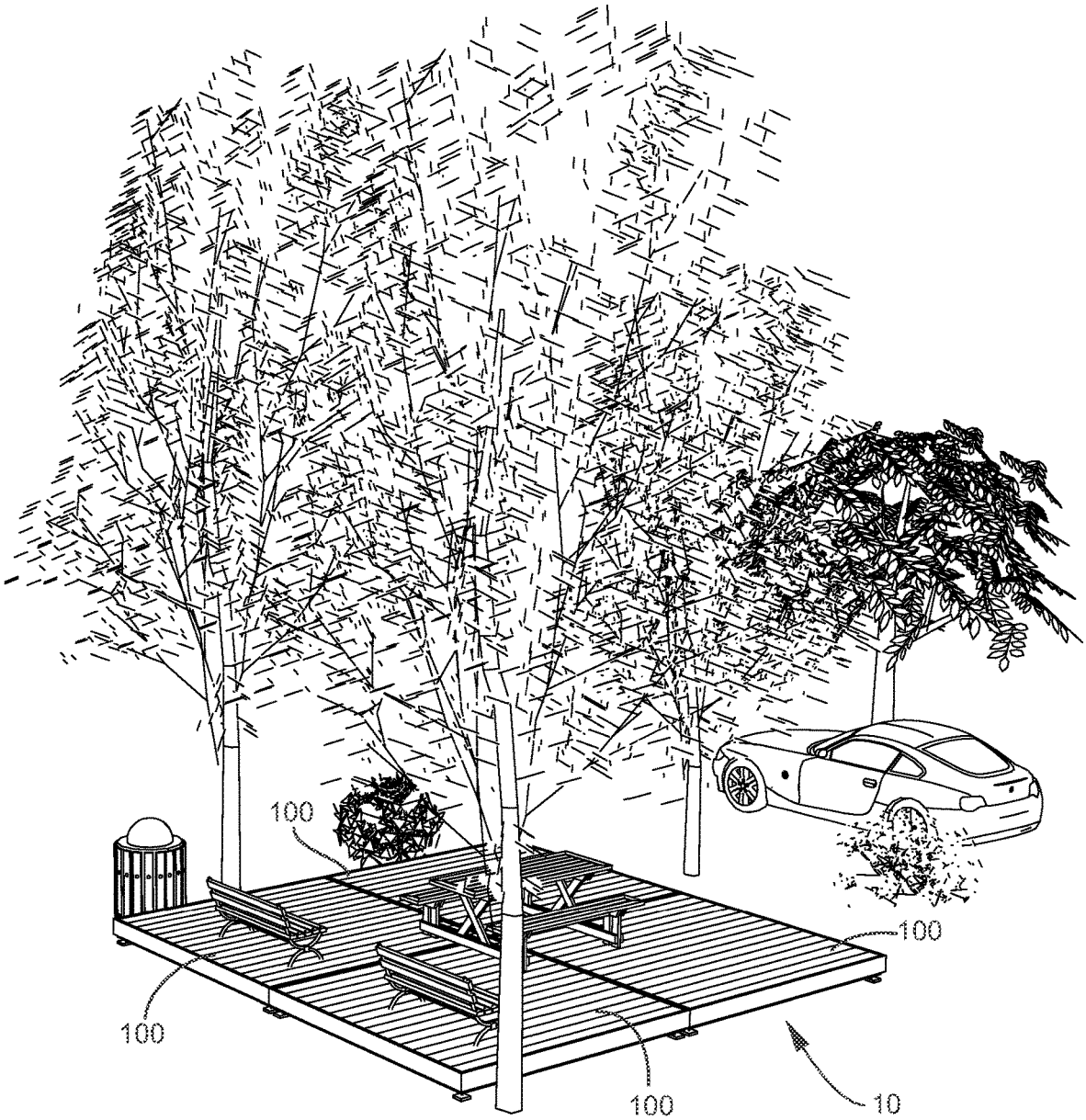
FIG. 1 is an environmental illustration of the modular decking system disclosed herein.
Figure 2:
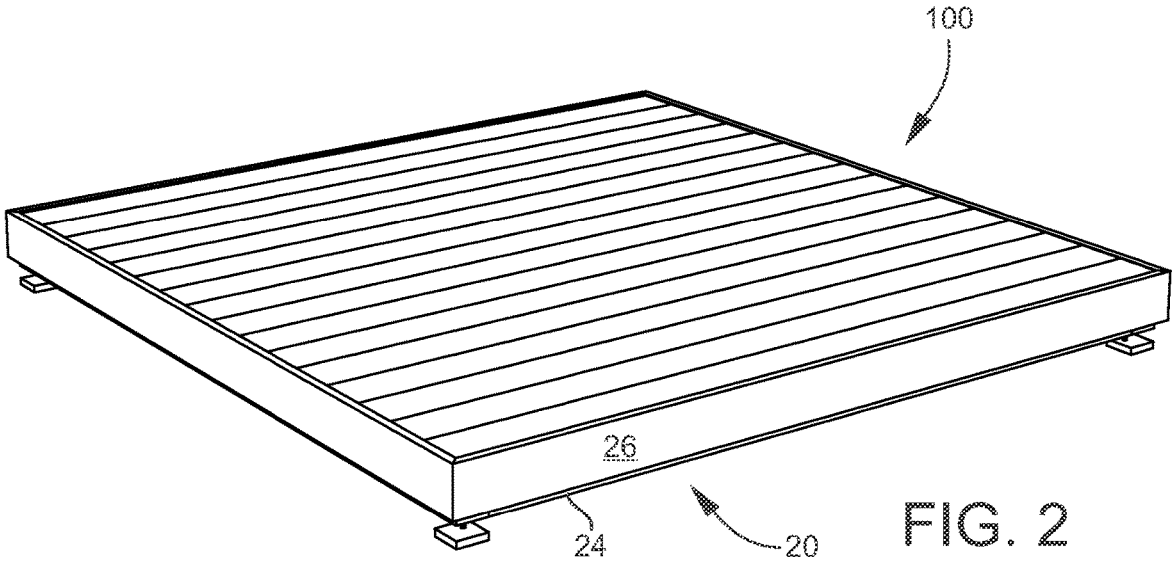
FIG. 2 is an illustration of a top side of one modular component of the modular decking system.

Referring to the drawings, where like numerals indicate like elements, there is shown, in FIG. 1, a presently preferred embodiment of the present invention, a modular decking system 10 consisting of 4 modular components 100. In addition to the illustrated modular components 100, the system 10 may be supplemented with accessories such as, but not limited to, a removable canopy, a plurality of removable block extension (for elevating the deck), a removable staircase, a removable railing, and/or a removable ramp (not shown). Each of these accessories may be configured, as necessary.

In general, each modular component 100 may have any dimensions and surface shape, but it is present preferred that the surface shape be square and its dimensions be 8 foot×8 foot (96 inches×96 inches). Each modular component 100 generally includes: a frame 20, a deck 30, a screw jack 40, and alignment blocks 50. Each will be discussed in greater detail below.

The frame 20, best seen in FIG. 3, may include: an exterior periphery 22 defined by an interior 5/4 inch pressure treated deck board 24 and an exterior 5/4 inch deck board 26 that are vertically disposed and fastened together with the interior board offset below the exterior board by a thickness of the deck board. A plurality of 5/4 inch pressure treated deck boards forming cross members 28 within the frame 20, and a plurality of 4×4 inch pressure treated blocks 40 located at each corner of the frame and extending to the bottom of or below the interior deck board.

Figure 3:
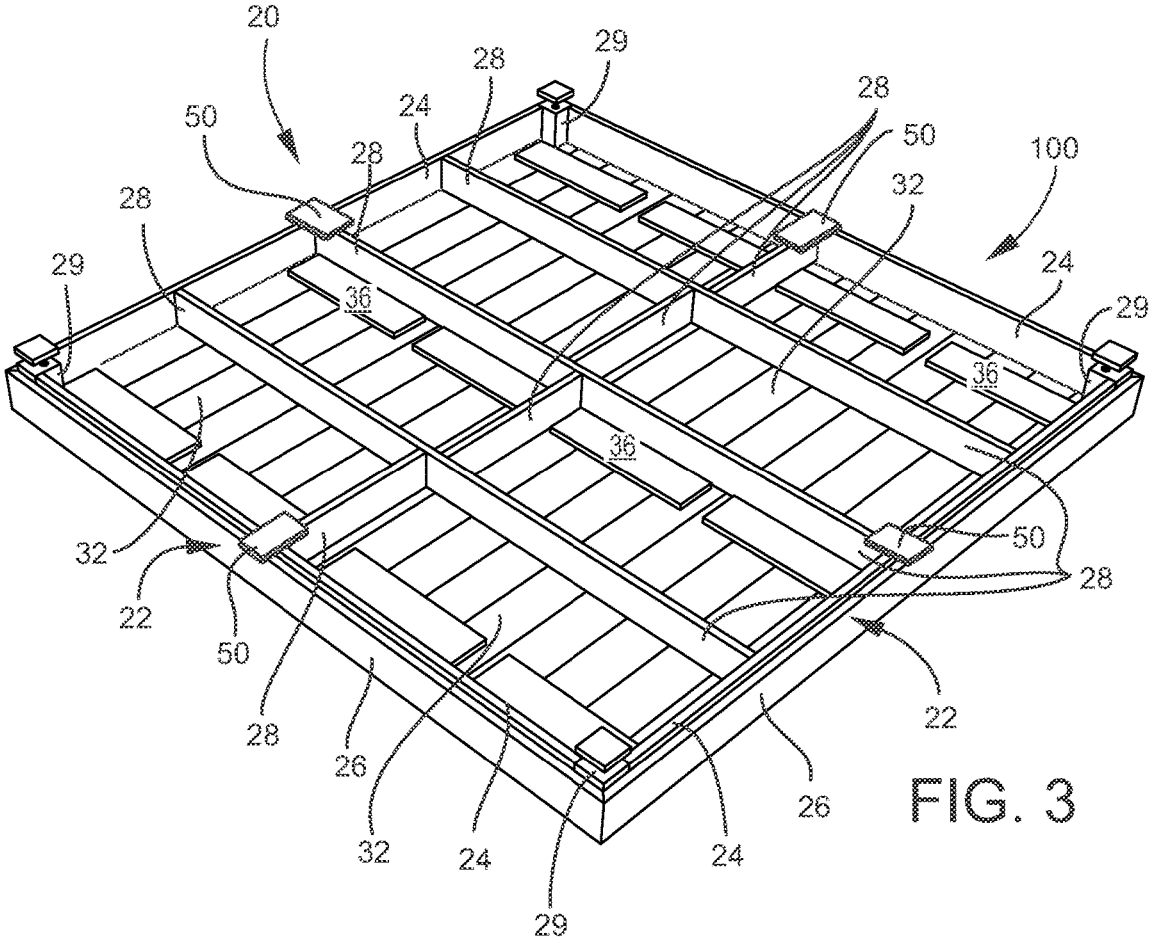
FIG. 3 is an illustration of a bottom side of the modular component shown in FIG. 2.
Figure 4:
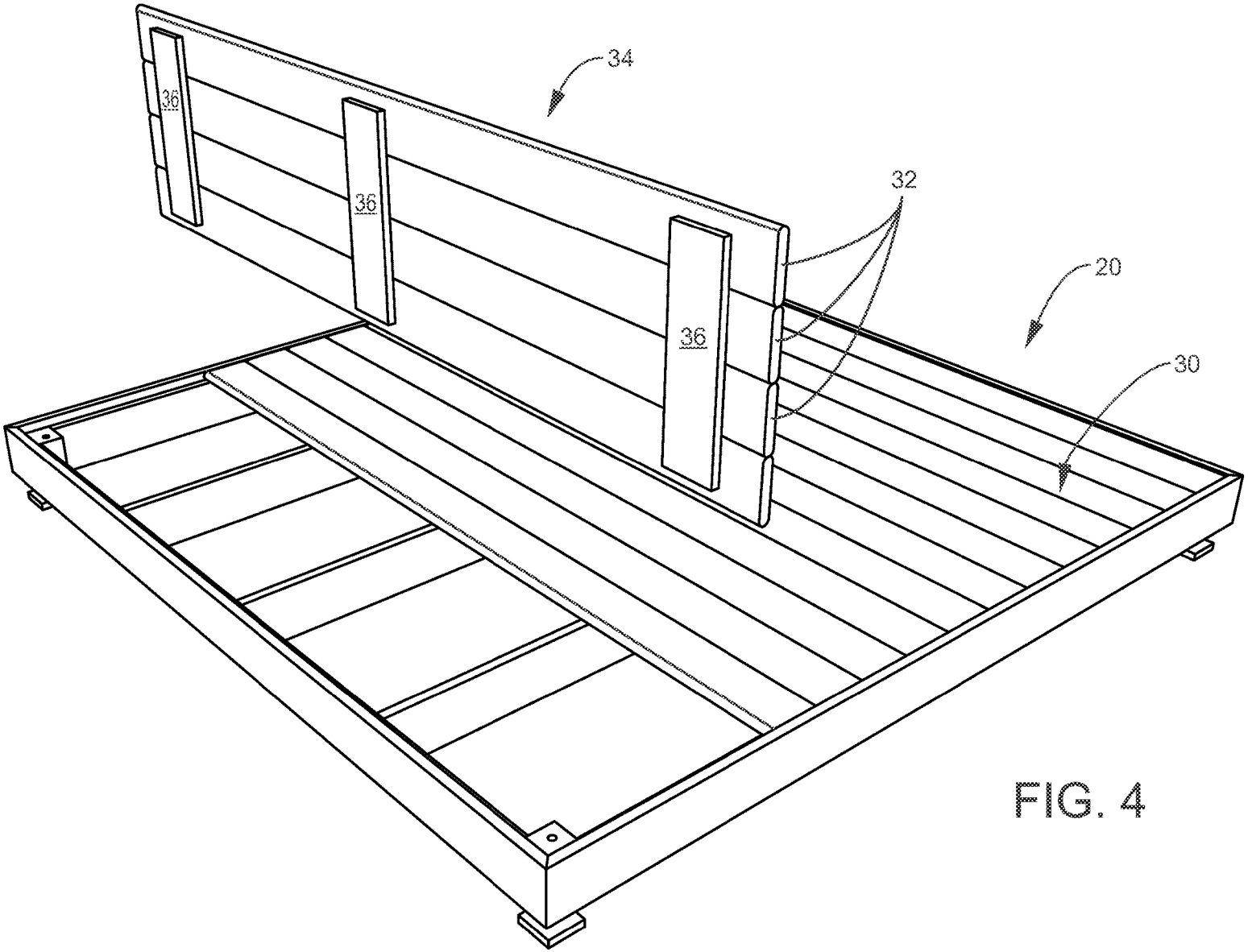
FIG. 4 is an illustration of one modular component with a panel removed.

The deck 30, best seen in FIGS. 3 and 4, may include a plurality of 5/4 inch pressure treated deck boards 32 horizontally disposed within the frame 20 and resting on the interior deck board 24 and the cross members 28 or a plurality of panels 34 including a plurality of 5/4 pressure treated deck boards 32 joined together with a 5/4 pressure treated deck board 36 horizontally joined to an underside of the deck boards forming the panel 34.

Figure 5:
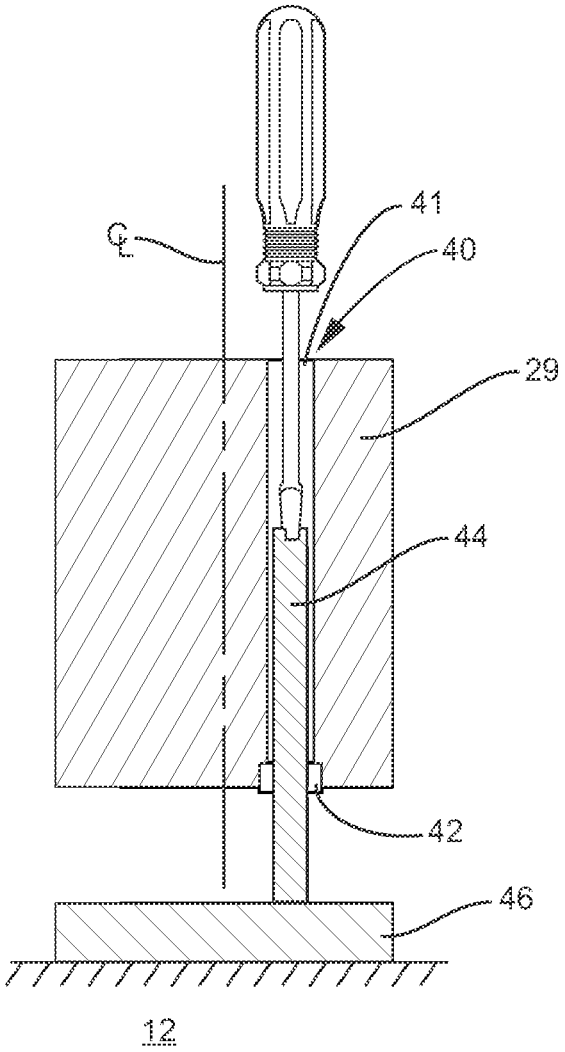
FIG. 5 is an illustration of a jack screw.

The screw jack 40, best seen in FIGS. 3 and 5, associated with each block 29. Each screw jack 40 may be disposed laterally offset from a center of the block away from the frame periphery. A split nut 42 affixed within the block 29 and a threaded rod 44 fit into the nut for movement up and down with the nut and foot 46 associated with a terminal end of the threaded rod for engagement with a ground surface 12, a vertical hole 41 formed within the block and the split nut is affixed within the lowermost end of the hole and the threaded rod is movable within the hole.

The plurality of alignment blocks 50, best seen in FIG. 3, where each alignment block is removably affixed to a bottom of the exterior periphery and extends outwardly beyond the exterior periphery. Alignment blocks are used to facilitate placement of modular components together in the system.

In use, the plurality of modular components is leveled and joined together, for example by screws, to from the deck surface.

The present invention may be embodied in other forms without departing from the spirit and the essential attributes thereof, and, accordingly, reference should be made to the appended claims, rather than to the foregoing specification, as indicating the scope of the invention.

I claim:

1. A modular decking system comprises:

a plurality of modular components, wherein each modular component includes a frame with an exterior periphery, the entire exterior periphery defined by an interior 5/4 inch deck board and an exterior 5/4 inch deck board that are vertically disposed and fastened together with the interior board offset below the exterior board by a thickness of a 5/4 inch deck board, a plurality of 5/4 inch deck boards forming cross members within the frame, and a 4×4 inch block located at each corner of the frame and extending to the bottom of or below the interior deck board, the block having a lower surface proximate a ground surface and an upper surface opposite the lower surface, a deck which includes a plurality of 5/4 inch deck boards horizontally disposed within the frame and resting on the interior deck board and the cross members, a screw jack associated with each 4×4 inch block, each screw jack is disposed offset from a center of the 4×4 inch block, and comprising a vertical through hole formed within the 4×4 inch block, the through hole having a lower most end proximate a ground surface and an upper most end distal the ground surface and co-planar with the upper surface of the block, a threaded rod at least partially positioned within the through hole, a split nut affixed within the lowermost end of the through hole, the threaded rod fit into the nut, the threaded rod moveable up and down within the through hole, and a foot associated with a terminal end of the threaded rod for engagement with the ground surface, wherein the threaded rod includes an upper end opposite the terminal end and accessible via the upper most end of the through hole, and a plurality of alignment blocks, each alignment block is removably affixed to a bottom of the exterior periphery and extends outwardly beyond the exterior periphery to facilitate placement of modular components together in the system, whereby the plurality of modular components are joined together and leveled to form a deck surface.

2. The modular decking system of claim 1 wherein the deck boards and blocks are pressure treated nominal lumber.

3. The modular decking system of claim 1 wherein each modular component is square and is approximately 8 foot×8 foot.

4. The modular decking system of claim 1 wherein the deck is formed by a plurality of panels including a plurality of additional 5/4 inch deck boards joined together with a 5/4 inch deck board horizontally joined to an underside of the deck boards forming the panel.

5. The modular decking system of claim 1, wherein the plurality of modular components comprises four modular components.

6. The modular decking system of claim 1, wherein the plurality of modular components consists of four modular components.

7. The modular decking system of claim 1, wherein the upper end of the threaded rod is adapted to receive and engage a tip of a screwdriver inserted through the upper most end of the through hole.

8. A modular decking system comprises:

a plurality of square modular components, each square modular component having a nominal dimension of 8 foot×8 foot or about 92 inch×92 inch and comprising a frame with an exterior periphery, the entire exterior periphery defined by an interior 5/4 inch pressure treated deck board and an exterior 5/4 inch deck board that are vertically disposed and fastened together with the interior board offset below the exterior board by a thickness of the 5/4 inch deck board, a plurality of 5/4 inch pressure treated deck boards forming cross members within the frame, and a 4×4 inch pressure treated blocks located at each corner of the frame and extending to the bottom of or below the interior deck board, the block having a lower surface proximate a ground surface and an upper surface opposite the lower surface, a deck which includes a plurality of 5/4 inch pressure treated deck boards horizontally disposed within the frame and resting on the interior deck board and the cross members or a plurality of panels including a plurality of 5/4 inch pressure treated deck boards joined together with a 5/4 inch pressure treated deck board horizontally joined to an underside of the deck boards forming the panel, a screw jack associated with each 4×4 inch block, each screw jack is disposed offset from a center of the 4×4 inch block, and comprising a vertical through hole formed within the 4×4 inch block, the through hole having a lower most end proximate a ground surface and an upper most end opposite the lower most end and co-planar with the upper surface of the block, a threaded rod at least partially positioned within the through hole, a split nut affixed within the lowermost end of the through hole, the threaded rod fit into the nut, the threaded rod moveable up and down within the through hole, and a foot attached to a terminal end of the threaded rod for engagement with a ground surface, and wherein the threaded rod includes an upper end opposite the terminal end and accessible via the upper most end of the through hole, and a plurality of alignment blocks, each alignment block is removably affixed to a bottom of the exterior periphery and extends outwardly beyond the exterior periphery to facilitate placement of modular components together in the system, whereby the plurality of square modular components are joined together and leveled to form a deck surface.

9. The modular decking system of claim 8, wherein the plurality of modular components comprises four square modular components.

10. The modular decking system of claim 8, wherein the plurality of square modular components consists of four square modular components.

11. The modular decking system of claim 8, wherein the upper end of the threaded rod is adapted to receive and engage a tip of a screwdriver inserted through the upper most end of the through hole.

* * * * *